US006362568B1

(12) United States Patent
Anderson et al.

(10) Patent No.: US 6,362,568 B1
(45) Date of Patent: Mar. 26, 2002

(54) ELECTRODE ASSEMBLY AND DISCHARGE LAMP COMPRISING THE SAME

(75) Inventors: James G. Anderson, Dundee, NY (US); Wayne P Strattman, Boston, MA (US); Jackson P Trentelman, Painted Post, NY (US)

(73) Assignee: Corning Incorporated, Corning, NY (US)

( * ) Notice: Subject to any disclaimer, the term of this patent is extended or adjusted under 35 U.S.C. 154(b) by 0 days.

(21) Appl. No.: 09/363,446

(22) Filed: Jul. 29, 1999

Related U.S. Application Data

(60) Provisional application No. 60/112,222, filed on Dec. 14, 1998.

(51) Int. Cl.[7] ..... H01J 17/18; H01J 61/36

(52) U.S. Cl. ..... 313/623; 313/624; 313/631

(58) Field of Search ..... 445/23, 24, 25, 445/26, 29, 70, 73; 313/623, 624, 625, 626, 631, 634, 238, 326, 331, 332, 333, 334, 335, 292

(56) References Cited

U.S. PATENT DOCUMENTS

| | | | | | |
|---|---|---|---|---|---|
| 1,293,441 | A | | 2/1919 | Houskeeper | |
| 1,743,569 | A | * | 1/1930 | Purdom | 313/587 |
| 3,450,924 | A | * | 6/1969 | Knochel et al. | 313/625 |
| 3,476,969 | A | * | 11/1969 | Ennulat et al. | 313/624 |
| 3,558,963 | A | * | 1/1971 | Hanneman et al. | 313/641 |
| 3,604,972 | A | * | 9/1971 | Levy | 313/552 |
| 3,778,126 | A | * | 12/1973 | Wilson | 445/25 |
| 3,784,860 | A | * | 1/1974 | Cocks et al. | 313/622 |
| 3,858,378 | A | | 1/1975 | Allen et al. | 52/759 |
| 3,974,410 | A | * | 8/1976 | Collins et al. | 313/43 |
| 4,035,682 | A | * | 7/1977 | Bubar | 313/565 |
| 4,339,685 | A | | 7/1982 | Saguchi et al. | 313/113 |
| 4,479,072 | A | | 10/1984 | Gaugel et al. | 313/113 |
| 4,482,842 | A | * | 11/1984 | Fujimura et al. | 313/634 |
| 4,584,501 | A | | 4/1986 | Cocks et al. | 313/493 |
| 4,803,403 | A | * | 2/1989 | Makar, Jr. et al. | 313/624 |
| 5,036,243 | A | | 7/1991 | Cocks et al. | 313/39 |
| 5,104,755 | A | | 4/1992 | Taylor et al. | 429/181 |
| 5,387,837 | A | | 2/1995 | Roelevink et al. | 343/484 |
| 5,519,284 | A | * | 5/1996 | Pepi | 313/623 |
| 5,654,606 | A | | 8/1997 | Weijtens et al. | 313/491 |
| 5,834,888 | A | | 11/1998 | Allen et al. | 313/484 |
| 5,858,046 | A | | 1/1999 | Allen et al. | 65/66 |

OTHER PUBLICATIONS

PCT International Patent application No. PCT/US99/02532, International filing date of Feb. 8, 1999, entitled, Channeled Glass Article and Method Therefor (Allen).

* cited by examiner

*Primary Examiner*—Nimeshkumar D. Patel
*Assistant Examiner*—Mariceli Santiago
(74) *Attorney, Agent, or Firm*—Anca C. Gheorghiu; Timothy M. Schaeberle

(57) ABSTRACT

An electrode assembly suitable for employment with low-pressure discharge lamps, and especially discharge lamps made from borosilicate glass. The electrode assembly comprises a hollow, stepped electrode holder having a tubular upper portion and a cylindrical lower portion comprising a tapered edge, and an electrode shell fastened to the tubular upper portion of the electrode holder. The electrode assembly may also further comprises a glass ring fused to the tapered edge of cylindrical lower portion of the electrode holder. The electrode assembly is suitable for use with low-pressure discharge lamps comprising glass tubes and low-pressure discharge lamps comprising envelopes having a gas-discharge channel. In a low-pressure discharge lamp, the electrode assembly of the present invention may be used as the discharge source, the evacuation and backfill site, and the seal site.

17 Claims, 3 Drawing Sheets

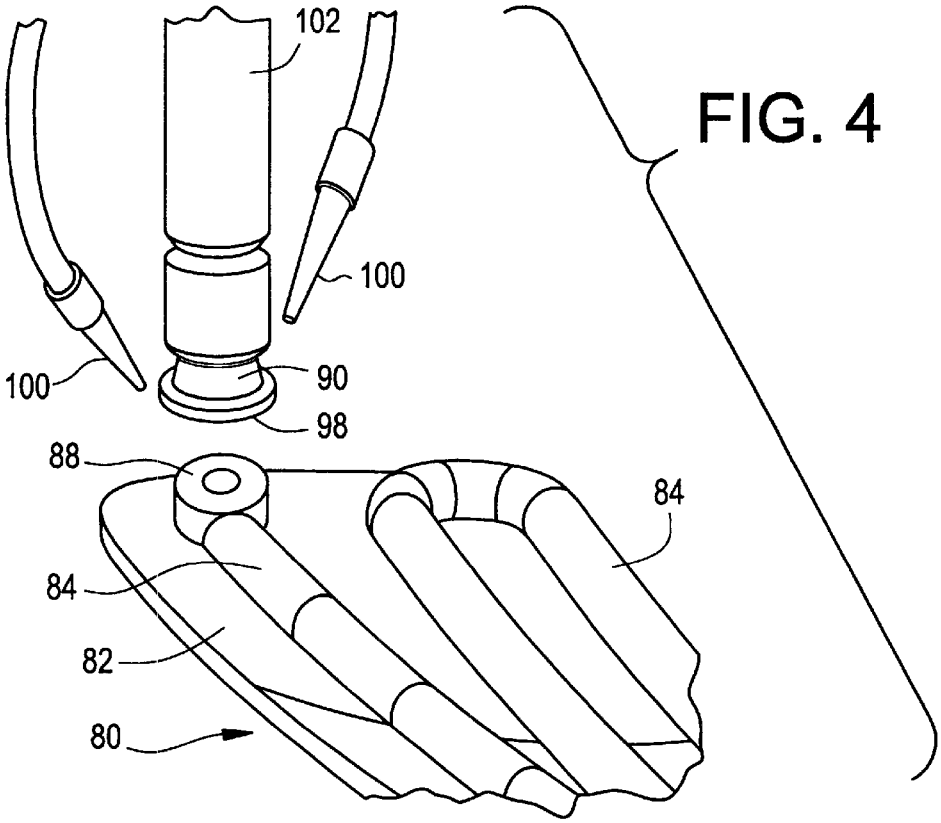
FIG. 4
FIG. 5
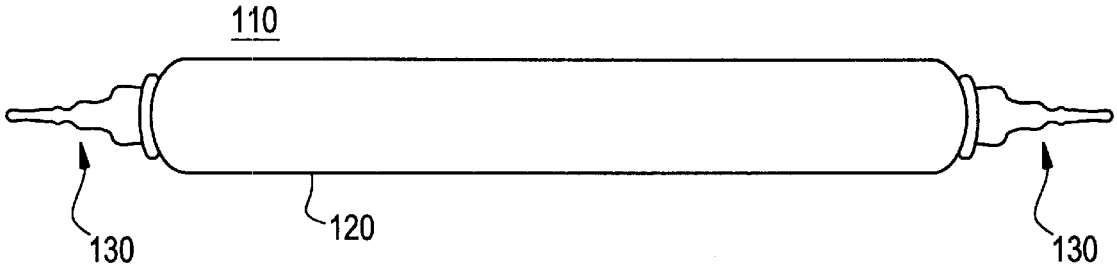

ELECTRODE ASSEMBLY AND DISCHARGE LAMP COMPRISING THE SAME

This application claims benefit of Provisional Appln. No. 60/112,222 filed Dec. 14, 1998.

BACKGROUND OF THE INVENTION

1. Field of Invention.

Generally the present invention relates to a discharge lamp which could be utilized for the purpose of automotive lighting applications. More particularly, the present invention relates to an electrode assembly suitable for employment in a low-pressure discharge lamp to produce a glow discharge therein, and method of attachment therefor. More particularly, the present invention relates to such an electrode assembly which is suitable for low-pressure discharge lamps comprising borosilicate glass, having a coefficient of expansion (CTE) of between $32–45\times10^{-7}/°C$.

2. Description of Related Art.

Typically, in a neon discharge lamp the electrode embodiment is located within the glass tubing and consists of a metal shell coated with an emissive coating. A connection to an external power source is made via a wire which is glass-to-metal sealed in the tubing. In order to ensure an hermetic glass-to-metal seal the metal wire must be compatible with the base glass, i.e., the coefficients of thermal expansion of the respective materials must closely match. Otherwise, mismatch in the respective coefficients of thermal expansion will yield a weak seal which will most likely leak and eventually lead to failure of the discharge lamp.

The traditional neon industry uses soft glass, such as soda lime glass or lead glass, which finds a near perfect expansion match in dumet wire, a nickel-iron alloy with a copper sheathing. However, for borosilicate glass the situation is less clear. Borosilicate glass, also known in the art as hard glass, is preferred for its good thermal properties, in particular good thermal shock resistance, resistance to weathering and low coefficient of expansion, which is typically about $35\times10^{-7}/°C$. The closest expansion match to borosilicate glass for any practical metal is tungsten, which has a CTE of $44\times10^{-7}/°C$. However, tungsten electrodes are expensive and difficult to manufacture due to the brittle nature of the metal. In addition borosilicate glass-to-tungsten seals are known to be notoriously leaky and often require a multiple glass seal between the borosilicate glass and tungsten metal. Nevertheless, tungsten is used because the alternatives are few.

One method to overcome glass-to-metal expansion mismatch and attain an hermetic seal is by using, what is known in the art as a Housekeeper seal. More information relative to the Housekeeper seal can be obtained, if such information is desired, by reference to U.S. Pat. No. 1,293,441 (Housekeeper). In particular, the Housekeeper seal is employed in the art of sealed beam headlamps made from borosilicate glass to join metal components, known as ferrules, to the reflector of the lamp. Ferrules act as sites for attachment of the incandescent filaments, and function to electrically connect the headlamp to external power circuitry. The ferrule is usually in the form of a hollow, stepped metal capsule closed at one end and open at the other end, the open end being joined to the glass reflector. If more information is desired relative to the use of ferrules in sealed beam headlamps, such information may be obtained by reference to U.S. Pat. No. 4,339,685 (Saguchi et al.) and U.S. Pat. No. 4,479,072 (Gaugel et al.).

The present invention employs the basic concept of the ferrule Housekeeper seal as a starting platform for the construction of an electrode assembly that provides a robust and relatively inexpensive glass-to-metal seal in low pressure borosilicate glass discharge lamps.

U.S. Pat. No. 5,387,837 (Roelevink et al.) discloses a low-pressure borosilicate glass discharge lamp comprising a cylindrically curved metal tube fused to a glass lamp, wherein the metal tube acts as the electrode, and comprises 29% by weight Ni, 17% by weight of Co, remainder Fe, or an Ni/Fe alloy. Even though a functional electrode for borosilicate glass is disclosed therein, in practice it is associated with a very high cost, inasmuch as a gradient seal would be required at the glass-to-metal interface.

OBJECTS OF THE INVENTION

An object of the present invention is to provide an electrode assembly having a robust borosilicate glass-to-metal seal and attachment method therefor, whereby the electrode assembly is also suitable for use in a low-pressure discharge lamp.

Another object of the present invention is to provide an electrode assembly having a long-life.

Still a further object is to provide an electrode assembly that is suited for high-volume production and is cost-efficient.

SUMMARY OF THE INVENTION

According to the present invention, these and other objects are achieved in the invention described herein. Briefly, the present invention resides in an electrode assembly having a robust seal at the metal and glass interface, and a method of attachment therefor to a low-pressure discharge lamp.

BRIEF DESCRIPTION OF THE DRAWINGS

These and other aspects of the present invention will be explained in greater detail with reference to the accompanying drawings, in which:

FIG. 4 is a cutout view of a method of attaching the electrode assembly of the present invention to a low-pressure discharge lamp.

FIG. 5 is a perspective view of a discharge lamp comprising a glass tube and an electrode assembly at opposite ends of the glass tube.

DETAILED DESCRIPTION OF THE PREFFERED EMBODIMENTS

Figure 1:
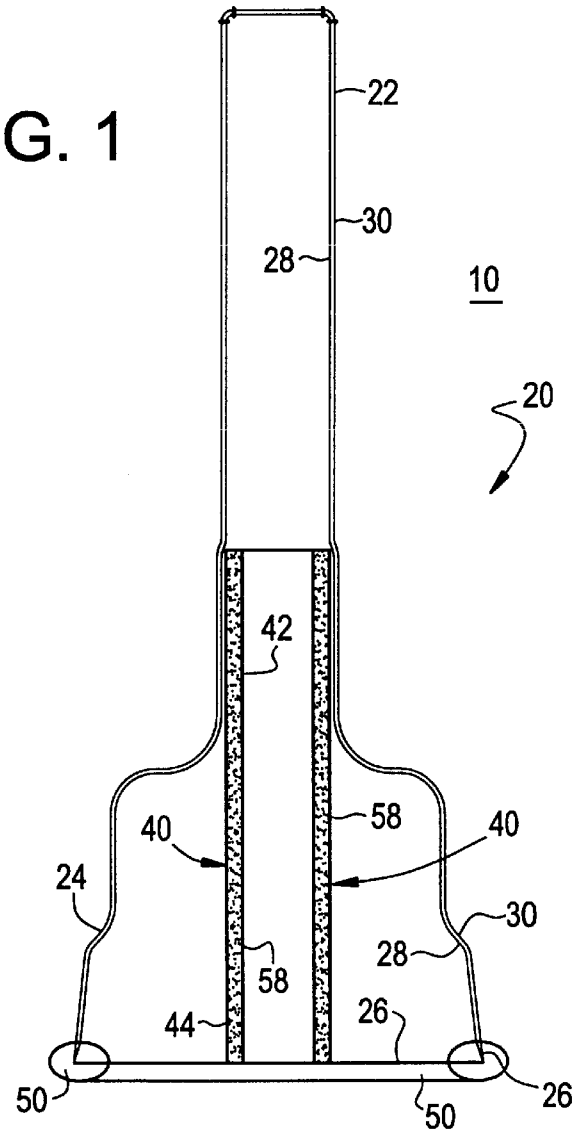
FIG. 1 is a cross-sectional view of an embodiment of the electrode assembly of the present invention.

FIG. 1 illustrates a typical embodiment of the electrode assembly of the present invention. Electrode assembly 10 comprises electrode holder 20, electrode shell 40, and glass ring 50. Electrode holder 20 is a hollow, stepped metal structure which comprises tubular upper portion 22 and cylindrical lower portion 24. Cylindrical lower portion 24 ends with tapered edge 26, said tapered edge having a thickness of between 0.002"–0.005". As used herein "tapered edge" refers to that section of cylindrical lower portion 24 which is employed to achieve a Housekeeper seal between metal electrode holder 20 and glass ring 50. Electrode holder 20 further comprises an inner surface 28 and outer surface 30. Electrode holder 20 is made of metal preferably Alloy 42, a low-expansion metal having a CTE of $54\times10^{-7}$/°C., and a composition consisting essentially of 0.05% by weight carbon, 0.4% by weight manganese, 0.2% by weight silicon, 41% nickel, and the balance iron.

Electrode shell 40 is a metal tube fastened, i.e., hard-soldered, brazed or welded, to inner surface 28 of electrode holder 20 at tubular upper portion 22, wherein electrode shell 40 extends down into cylindrical lower portion 24 and is flush with feather edge 26. Electrode shell 40 further comprises inner surface 42 and outer surface 44. Electrode shell 40 preferably comprises, for example, nickel or nickel plated iron. Alternatively the electrode shell may be made of any material which forms a good substrate for emissive coatings, including but not limited to Alloy 42. An emissive coating 58 which acts as a electron emitting medium, is disposed on inner surface 42 of electrode shell 40. The emissive coating is preferably barium carbonate and/or strontium carbonate and/or calcium carbonate, which converts at high temperature to an oxide.

It is to be understood that cylindrical lower portion 24 is a preferred shape, and that other shapes, for example, round are suitable for the present invention, as long as said portion ends with a tapered edge.

A suitable electrode assembly for the present invention may also be contemplated by applying emissive coating directly to inner surface 28 of electrode holder 20, and eliminating electrode shell 40. Nonetheless, to achieve long lamp-life and optimum operating conditions in a low-pressure discharge lamp disclosed in the present invention, an electrode shell as described herein should be provided. As used herein "electrode shell" is that component of the electrode assembly of the present invention to which an emissive coating is applied.

Glass ring 50 is fused to tapered edge 26 of cylindrical lower portion 24, for instance by melting. Glass ring 50 is preferably made of Corning Code 7740 borosilicate glass having a CTE of $38\times10^{-7}$/°C., the glass composition consisting essentially, expressed in terms of weight percent on the oxide basis, of about 81% $SiO_2$, 13% $B_2O_3$, 2% $Al_2O_3$, 4% $Na_2O$. The glass ring may also be made of including, but not limited to aluminosilicate and boro-aluminosilicate. In this regard, it should be noted that the selection of glass has a direct impact on the choice of metal employed in the production of the electrode holder. As described herein, the choice of glass and metal employed should preferably be compatible with respect to the CTE, i.e., the CTE of each material should be as closely matched as possible, in order to ensure a robust glass-to-metal seal. However, another consideration in choosing the metal for the electrode holder must be the nature of metal, i.e., a metal that is not brittle and can be shaped.

It is to be understood that the electrode assembly described herein above is a preferred embodiment, and that alternately glass ring 50 may be removed. Glass ring 50 is employed, as will become apparent from further discussion herein below, to attain a glass-to-glass seal at the electrode assembly-discharge lamp interface. Further, said glass ring is especially desirable when sealing to thin, light weight discharge lamp glass envelopes, as described herein below.

A cost effective method of manufacturing electrode holder 20 may, for example, be stamping, i.e., a process well known in the art by which sheet stock is progressively formed to the desired shape at high speed.

Electrode assembly 10 is preferably 2 inches in length.

Figure 2:
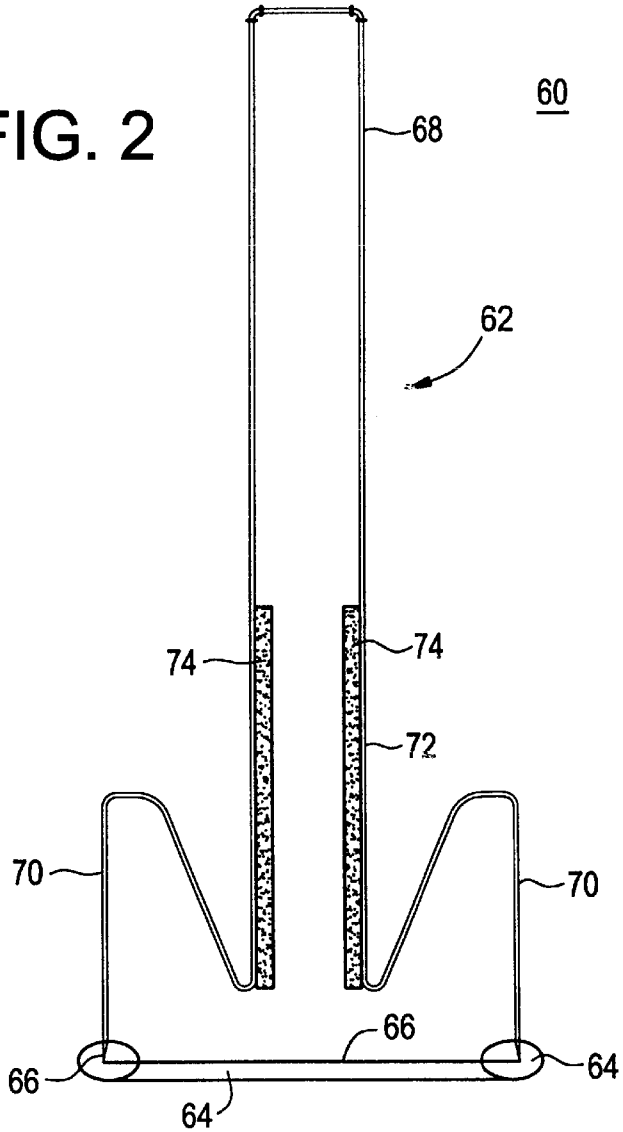
FIG. 2 is a cross-sectional view of another embodiment of the electrode assembly of the present invention.

FIG. 2 illustrates another embodiment of the electrode assembly of the present invention. Electrode assembly 60 comprises electrode holder 62, and glass ring 64. Electrode holder 62 comprises tubular upper portion 68 and cylindrical lower portion 70, wherein cylindrical lower portion 70 comprises tapered edge 66. In the embodiment of FIG. 2, a one piece electrode assembly is illustrated, i.e., electrode shell 72 is integral with tubular upper portion 68. More specifically electrode shell 72 is that section of tubular portion 68 to which an emissive coating 74 is applied. Although FIG. 2 as presented illustrates the emissive coating disposed only on a section of the tubular portion, it is suitable to coat the entire length of tubular portion 68 with the emissive coating.

Figure 3:
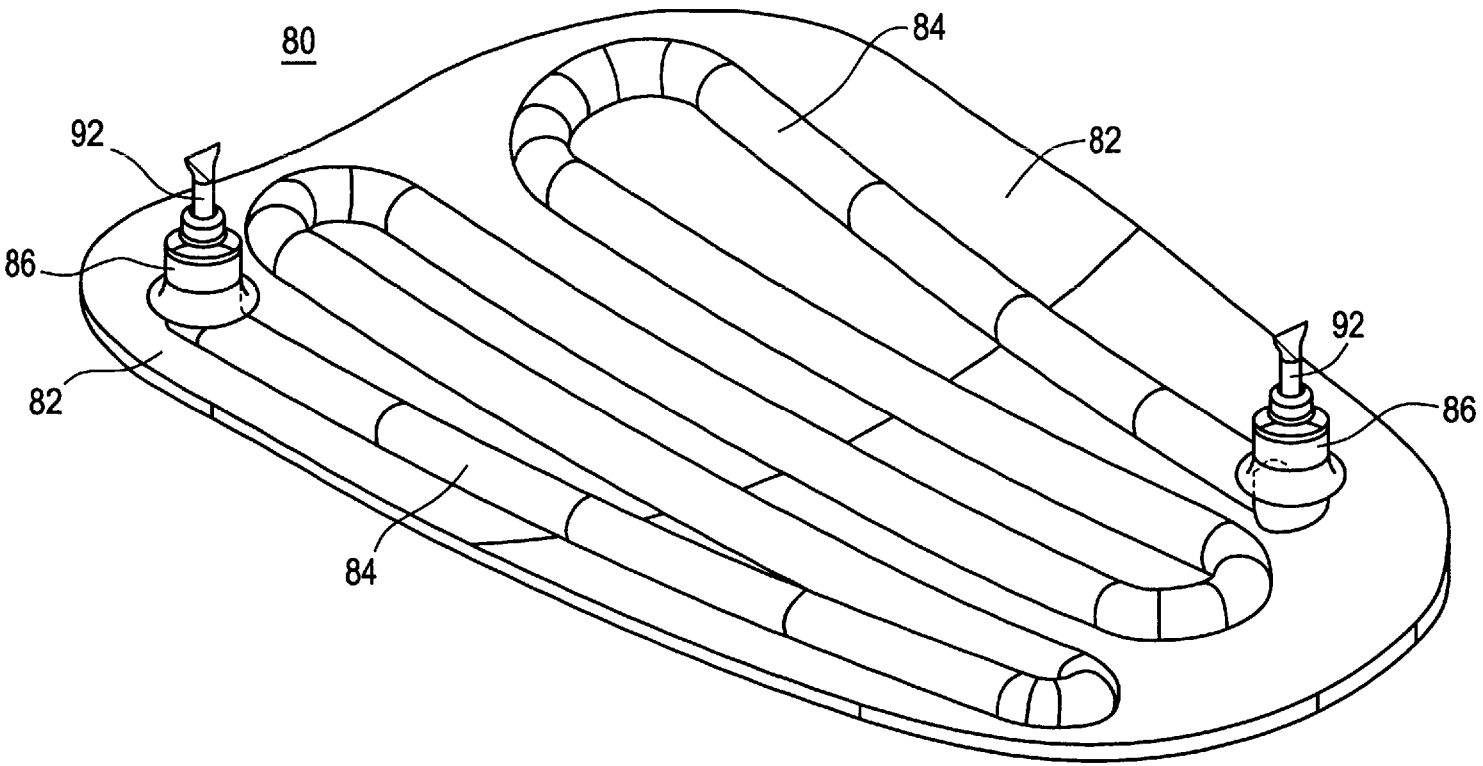
FIG. 3 is a perspective view of a low-pressure discharge lamp comprising a laminated envelope, the laminated envelope comprising a continuous gas-discharge channel and an electrode assembly in communication with and located at each end of the gas-discharge channel.

Referring now to FIGS. 3 and 4, therein illustrated is the electrode assembly of the present invention attached to a low-pressure discharge lamp. Discharge lamp 80 comprises envelope 82, wherein said envelope comprises a continuous gas-discharge channel 84 in a serpentine configuration. Envelope 82 is made of a transparent material such as glass, preferably Corning Code 7251 borosilicate glass having a CTE of $38\times10^{-7}$/°C., and a glass composition consisting essentially, expressed in terms of weight percent on the oxide basis of about 82% $SiO_2$, 12% $B_2O_3$, 2% $Al_2O_3$, 4% $Na_2O$. It is also contemplated, that the laminated envelope may also be comprised of a glass selected from the group consisting of aluminosilicate and boro-aluminosilicate.

Electrode assemblies 86 are in communication with and located at opposite ends of gas-discharge channel 84 at electrode sites 88 (FIG. 4). Electrode assemblies 86 are attached to envelope 82 as illustrated in FIG. 4. Sealing burners 100 heat glass ring 98 and electrode site 88 to a point above the softening range of temperatures of the glass, whereby a glass-to-glass seal is attained as glass ring 98 is brought into contact with electrode site 88 by electrode chuck 102.

As discussed herein above, glass ring 98 may be removed and electrode holder 90 may be fused directly into electrode site 88, whereby a glass-to-metal seal is attained at the electrode assembly-discharge lamp envelope interface.

Suitable glass envelopes for the present invention are disclosed in U.S. Pat. No. 4,584,501 (Cocks et al.) and U.S. Pat. No. 5,036,243 (Cocks et al.), herein incorporated by reference. Both patents disclose flat glass envelopes made of glass plates sealed together, for example, via a frit.

A preferred embodiment for a glass envelope comprising at least one gas-discharge channel and method of making the same is disclosed in U.S. Pat. No. 5,858,046 (Allen et al.) and U.S. Pat. No. 5,834,888 (Allen et al.) (a division of U.S. Pat. No. 5,858,046; co-assigned to the instant assignee and herein incorporated by reference. The disclosed method comprises: (a) delivering a first or channel-forming ribbon of molten glass to a surface of a mold assembly having a mold cavity possessing at least one channel-forming groove formed therewithin and a peripheral surface, wherein the channel-forming ribbon overlies the mold cavity and the peripheral surface of the mold assembly; (b) causing the channel-forming ribbon of molten glass to substantially conform to the contour of the mold cavity resulting in the formation of at least one channel in the ribbon of the molten glass; (c) delivering and depositing a second or sealing ribbon of molten glass to the outer surface of the channel-forming ribbon of molten glass wherein the viscosity of the sealing ribbon is such that the sealing ribbon bridges but does not sag into contact with the surface of the channel of the channel-forming ribbon but is still molten enough to form a hermetic seal wherever the sealing ribbon contacts the channel-forming ribbon, thereby resulting in a glass article possessing at least one enclosed channel; and, (d) removing the glass article from the mold. Conformance of the channel-forming molten glass ribbon to the mold cavity is attained by gravity forces, vacuum actuation or a combination of both. The glass envelope formed by the above described method comprises a front surface and a back surface laminated and integrated together to form a unitary envelope body essentially free of any sealing materials and having at least one gas discharge channel. The laminated glass envelope exhibits a weight to area ratio of $\leqq 1.0$ g/cm$^2$.

Another method of forming laminated glass envelopes is disclosed in PCT International Patent Application Number PCT/US99/02532 (Allen); co-assigned to the instant assignee and herein incorporated by reference. The method comprises: (a) delivering and depositing a first or channel-forming ribbon of molten glass to a surface of a mold assembly having a mold cavity possessing at least one channel-forming groove formed therewith and a peripheral surface, wherein the channel-forming ribbon overlies the mold cavity and the peripheral surface of the mold assembly; (b) causing the channel-forming ribbon of molten glass to substantially conform to the contour of the mold cavity resulting in the information of at least one channel in the ribbon of the molten glass; (c) delivering and depositing a second or sealing ribbon of molten glass to the outer surface of the channel-forming ribbon of molten glass wherein the viscosity of the sealing ribbon is such that the sealing ribbon (i) bridges but does not sag into complete contact with the surface of at least one channel of the channel-forming ribbon and (ii) forms a hermetic seal wherever the seal ribbon contacts the channel-forming ribbon to form a glass article with at least one enclosed channel; (d) causing the sealing ribbon to stretch so that the sealing ribbon has a thin cross-section and so that the hermetic seal between the sealing ribbon and the channel ribbon has a thin cross-section; and, (e) removing the glass article from the mold. The glass envelope formed by the above described method comprises a front surface and a back surface laminated and integrated together to form a unitary envelope body essentially free of any sealing materials and having at least one gas discharge channel, wherein the gas-discharge channel has a front surface having a thin cross-section and wherein the laminated glass envelope has a thin cross-section. The laminated glass envelope exhibits a weight to area ratio of $\leqq 1.0$ g/cm$^2$.

An advantage of the present invention is that tubular upper portion 92 (FIG. 3) may be employed to evacuate and backfill gas-discharge channel 84 with an ionizable gas. Therefore, the need for a separate tubulation port is eliminated, resulting in envelope design and process simplification and also cost efficiency. Nonetheless, an envelope comprising a tubulation port is also suitable for the present invention.

After evacuation and backfilling, tubular upper portion 92 is sealed by crimping the metal using known techniques, whereby communication with the external environment is discontinued.

As described herein above, advantages of the present invention are that electrode assembly 86 (FIG. 3) not only forms the seal between the electrode and discharge lamp envelope, but also acts as the discharge source, the evacuation and backfill site, and the crimp site. As described herein "crimp site" refers that portion of the discharge charge lamp at which communication with the external environment is discontinued.

Any of the noble gases or mixtures thereof may be used for the ionizable gas, including neon, xenon, krypton, argon, helium, and mixtures thereof with mercury. In a preferred embodiment discharge lamp 80 (FIG. 3) is a neon lamp.

Discharge lamps utilizing the electrode assembly of the present invention find employment in the fields of neon and fluorescent lighting, and automobile lighting. Laboratory tests performed on discharge lamps as illustrated in FIG. 3 confirm and exceed the requisite lamp life, i.e., >2000 hours on lamps which exceed required brake light intensity, for automotive applications, as dictated by SAE (Society of Automotive Engineers).

Referring now to FIG. 5 therein is illustrated another embodiment of a discharge lamp employing the electrode assembly of the present invention. Discharge lamp 110 comprises glass tube 120, electrode assemblies 130 located at opposite ends of glass tube 120. It is contemplated that glass tube 120 can be molded in numerous shapes, for example, a serpentine shape.

Although the now preferred embodiments of the invention have been set forth, it will be apparent to those skilled in the art that various changes and modifications may be made thereto without departing from the spirit and scope of the invention as set forth in the following claims.

What is claimed is:

1. An electrode assembly for low-pressure discharge lamps, said electrode assembly comprising:

an electrode holder having a tubular upper portion and a cylindrical lower portion, said cylindrical lower portion ending with a tapered edge; and, an electrode shell fastened to said tubular upper portion, said electrode shell extending into said cylindrical lower portion.

2. The electrode assembly of claim 1, wherein said electrode holder is made of a metal consisting essentially of about 0.05% by weight carbon, 0.4% by weight manganese, 0.2% by weight silicon, 41% by weight nickel, and 58.35% by weight iron.

3. The electrode assembly of claim 1, wherein said electrode shell is made of a metal consisting essentially of about 0.05% by weight carbon, 0.4% by weight manganese, 0.2% by weight silicon, 41% by weight nickel, and the balance iron.

4. The electrode assembly of claim 1, wherein said electrode shell is integral with said tubular upper portion of said electrode holder.

5. The electrode assembly of claim 1 further comprising a glass ring fused to said tapered edge of said cylindrical lower portion.

6. The electrode assembly of claim 5, wherein said electrode shell is made of a metal selected from the group consisting of nickel and nickel plated iron.

7. The electrode assembly of claim 5, wherein said glass ring is made a glass selected from the group consisting of borosilicate, aluminosilicate and boro-aluminosilicate.

8. The electrode assembly of claim 5, wherein said glass ring is made of a glass consisting essentially, expressed in weight percent on the oxide basis, of about 81% $SiO_2$, 13% $B_2O_3$, 2% $Al_2O_3$, 4% $Na_2O$.

9. The electrode assembly of claim 5, wherein said electrode assembly is 2 inches in length.

10. A discharge lamp comprising:

an envelope having at least one gas-discharge channel; and, an electrode assembly in communication with and at each end of said gas-discharge channel, said electrode assembly comprising an electrode holder having a tubular upper portion and a cylindrical lower portion, said cylindrical lower portion ending with a tapered edge, an electrode shell fastened to said tubular upper portion, said electrode shell extending into said cylindrical lower portion, and a glass ring fused to said tapered edge of said cylindrical lower portion.

11. The discharge lamp of claim 10, wherein said envelope comprises a front surface and a back surface laminated and integrated together to form a unitary envelope body essentially free of any sealing materials, said envelope exhibiting a weight to area ratio of $\leqq 1.0$ g/cm$^2$.

12. The discharge lamp of claim 11, wherein said envelope is made of glass selected from the group consisting of borosilicate, aluminosilicate and boro-aluminosilicate.

13. The discharge lamp of claim 12, wherein said envelope is made of glass consisting essentially, expressed in terms of weight percent on the oxide basis of about 82% $SiO_2$, 12% $B_2O_3$, 2% $Al_2O_3$, 4% $Na_2O$.

14. The discharge lamp of claim 10, wherein said tubular upper portion of said electrode holder is used to evacuate and backfill said gas-discharge channel with an ionizable gas.

15. The discharge lamp of claim 14, wherein said ionizable gas is selected from the group consisting of neon, xenon, krypton, argon, helium and mixtures thereof with mercury.

16. The discharge lamp of claim 14, wherein said tubular upper portion of said electrode holder is sealed, whereby communication with the external environment is discontinued for said discharge lamp.

17. A discharge lamp comprising a glass tube and an electrode assembly in communication with, and at each end of said glass tube, said electrode assembly comprising an electrode holder having a tubular upper portion and a cylindrical lower portion, said cylindrical lower portion ending with a tapered edge, an electrode shell fastened to said tubular upper portion, said electrode shell extending into said cylindrical lower portion, and a glass ring fused to said tapered edge of said cylindrical lower portion.

* * * * *